US006670088B1

(12) United States Patent
Matsuda et al.

(10) Patent No.: US 6,670,088 B1
(45) **Date of Patent: *Dec. 30, 2003**

(54) CARRIER FOR TWO-COMPONENT DEVELOPER FOR DEVELOPING LATENT ELECTROSTATIC IMAGES AND DEVELOPER USING THE CARRIER

(75) Inventors: Hiroaki Matsuda, Shizuoka (JP); Masanori Suzuki, Shizuoka (JP); Akemi Sugiyama, Shizuoka (JP); Hiroto Higuchi, Shizuoka (JP)

(73) Assignee: Ricoh Company, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 305 days.

(21) Appl. No.: 09/276,489

(22) Filed: Mar. 25, 1999

(30) Foreign Application Priority Data

Mar. 31, 1998 (JP) ..... 10-103608

(51) Int. Cl.[7] ..... G03G 9/113

(52) U.S. Cl. ..... 430/111.1; 430/111.32; 430/111.35

(58) Field of Search ..... 430/106.6, 108, 430/111.1, 111.32, 111.35

(56) References Cited

U.S. PATENT DOCUMENTS

| | | | | | |
|---|---|---|---|---|---|
| 4,600,677 | A | * | 7/1986 | Hoffend et al. | 430/108 |
| 4,672,016 | A | * | 6/1987 | Isoda et al. | 430/108 |
| 5,079,124 | A | * | 1/1992 | Kawata et al. | 430/108 |
| 5,342,721 | A | * | 8/1994 | Akamatsu | 430/108 |
| 5,885,742 | A | * | 3/1999 | Okado et al. | 430/108 |

FOREIGN PATENT DOCUMENTS

| | | | | |
|---|---|---|---|---|
| JP | 63-80268 | * | 4/1988 | |
| JP | 63-198077 | * | 8/1988 | |
| JP | 2-8861 | * | 1/1990 | |
| JP | 4-198946 | * | 7/1992 | 430/108 |
| JP | 06-118725 | * | 4/1994 | |

OTHER PUBLICATIONS

Derwent Abstract 90–061528/09 of JP 2–8861 (Pub Jan. 12, 1990), Attached to JP 2–8861.*

Derwent Abstract 88–268870/38 of JP 63–198077 (Pub Aug. 1988) Attached to JP 63–198077.*

Morrison & Boyd, *Organic Chemistry*, Allyn and Bacon, Inc, Boston (Mar., 1965), pp 531–532.*

U.S. Patent & Trademark Office English–Language Translation of JP 63–80268 (Pub Apr. 11, 1988).*

Caplus Abstract AN 1993:29991 of JP 4–198946, Published 1993.*

CAPLUS Abstract AN 1988:501945 of JP 62–121091, Published 1988.*

ACS File Registry RN 308073–56–5 Copyright 2001.*

ACS File Registry RN 308073–85–0, Copyright 2001.*

ACS File Registry RN 66587–52–8, Copyright 2001.*

ACS File Registry RN 66587–53–9, Copyright 2001.*

U.S. Patent & Trademark Office English–Language Translation of JP 4–198946 (Pub. Jul. 1992).*

Japanese Patent Office Machine–Assisted Translation of JP 06–118725 (Pub Apr. 28, 1994).*

* cited by examiner

*Primary Examiner*—Janis L. Dote
(74) *Attorney, Agent, or Firm*—Oblon, Spivak, McClelland, Maier & Neustadt, P.C.

(57) ABSTRACT

A carrier for a two-component developer for developing a latent electrostatic image is composed of carrier particles, each of the carrier particles having a core particle and a coating layer provided on the surface of the core particle, with the coating layer containing an amino-group-containing modified silicone resin. A two-component developer is composed of a toner and the above-mentioned carrier.

12 Claims, No Drawings

CARRIER FOR TWO-COMPONENT DEVELOPER FOR DEVELOPING LATENT ELECTROSTATIC IMAGES AND DEVELOPER USING THE CARRIER

BACKGROUND OF THE INVENTION

1. Field of the Invention

The present invention relates to a carrier for use in a two-component developer for developing latent electrostatic images, and a two-component developer using the above-mentioned carrier.

2. Discussion of Background

A two-component developer for use in the electrophotographic process is mainly composed of a toner component and a carrier component.

Carrier particles constituting the carrier are mixed and stirred together with the toner particles in a development unit so as to triboelectrically charge the toner particles and impart a desired polarity and charge quantity thereto. After that, the carrier particles lead the toner particles which are, as mentioned above, provided with a predetermined charge quantity, to a latent electrostatic image formed on the surface of a photoconductor, where the toner particles are separated from the carrier particles and deposited on the latent electrostatic image, thereby forming a toner image on the photoconductor.

The carrier particles are then returned to the development unit and mixed and stirred with other remaining toner particles. Thus, the carrier particles are repeatedly used. Therefore, the carrier particles are required to constantly impart a desired charge quantity to the toner particles while in use, regardless of the change in environmental conditions.

However, in conventional developers, during the process of making a number of copies, there take place two major problems resulting from the collision between one carrier particle and another carrier particle and the friction between the carrier particles and the mechanical portions of the development unit.

One of the above-mentioned problems is a so-called spent phenomenon that a toner film is formed on the surface of the carrier particles. The other problem is that a resin-coated surface layer of each carrier particle tends to peel off or to be removed from the core particle.

Those problems occur because of a long-term stirring operation in the development unit. Consequently, the charging performance of the carrier is lowered, and the chargeability of the obtained developer is decreased, with the result that the quality of the obtained toner image is lowered, for example, the image density is insufficient or there occurs fogging in the image.

To inhibit the problems such as the spent phenomenon and the peeling of the resin-coated surface layer from the core particles for use in the carrier particles, there are proposed a variety of resins for the preparation of the above-mentioned surface layer of the carrier particles. However, no resin is satisfactory in terms of all the requirements for the carrier particles.

For instance, carrier particles coated with a styrene or acrylic polymer resin has a drawback in durability although the mechanical strength is sufficient. Namely, such carrier particles show relatively high critical surface tension, so that the surfaces of the carrier particles are apt to be contaminated during the repeated operations for a long period of time.

With respect to the conventional carrier particles coated with a silicone monomer resin, although the resistance to surface contamination of the carrier particles is excellent, the mechanical strength is poor. As a result, the silicone-monomer-resin coated surface layer of the carrier particles is readily worn out and peeled off through so long stirring operation.

For the purpose of reducing the wear and the peeling of the surface layer of the carrier particles, it is proposed in Japanese Laid-Open Patent Application 55-157751 to coat the core particles with a resin-modified silicone resin, in particular, an alkyd-resin-modified silicone resin or an epoxy-resin-modified silicone resin for the preparation of the resin-coated carrier particles. According to this method, the mechanical strength of the carrier particles is improved. However, the polarity of such a resin for use in the surface layer of the carrier particles is not strong enough for the resin-coated carrier particles to impart stable charge quantity to the toner particles.

Furthermore, in line with the trend toward resource saving, there is an increasing demand for efficient development using a minimum amount of developer. Therefore, the carrier for use in the two-component developer is required to have sufficient durability and a long life.

SUMMARY OF THE INVENTION

Accordingly, a first object of the present invention is to provide a carrier for use in a two-component developer, having excellent durability and a long life, and stable triboelectric charging characteristics so as to produce high quality toner images for an extended period of time.

A second object of the present invention is to provide a two-component developer employing the above-mentioned carrier.

The first object of the present invention can be achieved by a carrier for use in a two-component developer for developing a latent electrostatic image, comprising carrier particles, each of the carrier particles comprising a core particle and a coating layer provided on the surface of the core particle, with the coating layer comprising an amino-group-containing modified silicone resin.

The second object of the present invention can be achieved by a two-component developer for developing a latent electrostatic image, comprising a toner and the above-mentioned carrier.

DESCRIPTION OF THE PREFERRED EMBODIMENTS

It has been found that the stability of triboelectric charging between the toner particles and the carrier particles can be improved when each of the carrier particles comprises a core particle and a coating layer provided thereon comprising at least an amino-group-containing modified silicone resin. The reason for this is that the amino group to be contained in the coating layer of the carrier particle shows a remarkably strong positive polarity.

Further, when the coating layer for use in the carrier particle comprises an amino-group-containing organic compound or an amino-group-containing silicone compound and a resin-modilfied silicone resin in combination, the same effects as stated above can be obtained.

According to the present invention, the amino-group-containing modified silicone resin for use in the coating layer may be prepared by modifying a silicone resin using an amino-group-containing organic compound, preferably using an amino-group-containing resin. The preparation method for such a modified silicone resin is as follows:

[Method (1)]

There is proposed a method of carrying out the condensation reaction between an amino-group-containing resin, such as an amino-group-containing acrylic resin, alkyd resin, melamine resin, epoxy resin, phenolic resin, esterified epoxy resin, urethane resin, polyester resin or ethyl cellulose resin, and a silicone resin having a functional group capable of undergoing the condensation reaction with the above-mentioned amino-group-containing resin.

In the above-mentioned method (1), the resin employed to modify the silicone resin comprises an amino group. The silicone resin subjected to modification has a functional group capable of undergoing the condensation reaction with the above-mentioned amino-group-containing resin. The silicone resin may further comprise an amino group.

Examples of such a functional group for use in the silicone resin are hydroxyl group; an alkoxyl group having 1 to 4 carbon atoms, such as methoxy group or ethoxy group; an alkenyloxy group having 2 to 4 carbon atoms, such as vinyloxy group; phenoxy group; carboxyl group; and epoxy group such as ethyleneoxide group or glycidyl group.

The above-mentioned functional group may be bonded to a silicon atom directly, or through an alkylene group or an arylene group.

The molecular weight of the silicone resin to be subjected to modification is not particularly limited. It is preferable that the average molecular weight of the silicone resin be in the range of 90 to 500,000, more preferably in the range of 300 to 500,000 before the silicone resin is subjected to modification.

A silicone resin represented by the following formula (I) is preferably employed for modification in the present invention:

(I)

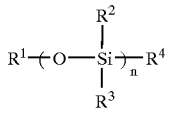

wherein $R^1$ is a hydrogen atom, an alkyl group having 1 to 4 carbon atoms, or phenyl group; $R^2$ and $R^3$ are each a hydrogen atom, an alkyl group having 1 to 4 carbon atoms, an alkoxyl group having 1 to 4 carbon atoms, phenyl group, phenoxy group, an alkenyl group having 2 to 4 carbon atoms, an alkenyloxy group having 2 to 4 carbon atoms, hydroxyl group, carboxyl group, ethyleneoxide group, glycidyl group or

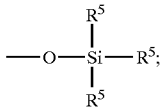

$R^4$ and $R^5$ are each hydroxyl group, carboxyl group, an alkyl group having 1 to 4 carbon atoms, an alkoxyl group having 1 to 4 carbon atoms, an alkenyl group having 2 to 4 carbon atoms, an alkenyloxy group having 2 to 4 carbon atoms, phenyl group, or phenoxy group; and n is an integer of 1 or more.

Each of the above-mentioned groups represented by $R^1$ to $R^5$ may have a substituent, such as amino group, hydroxyl group, carboxyl group, mercapto group, an alkyl group, phenyl group, ethyleneoxide group, glycidyl group, or a halogen atom.

Specific examples of the silicone resin represented by formula (I) are as follows:

(1)

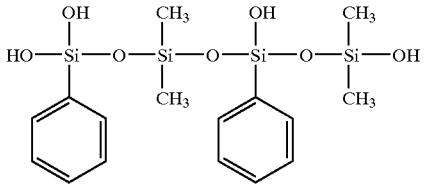

(2)

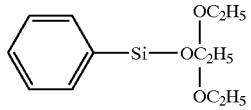

(3)

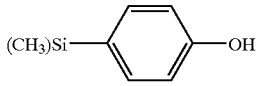

(4)

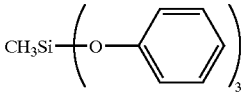

(5)

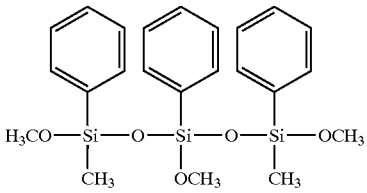

(6)

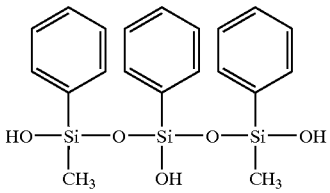

(7)

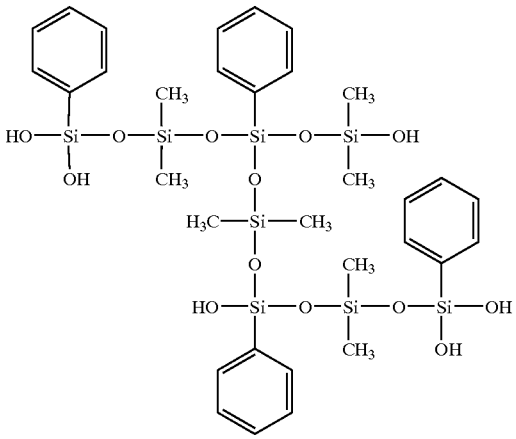

(8)

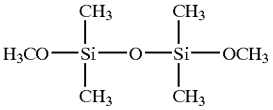

-continued (9)

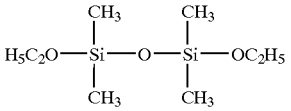

(10)

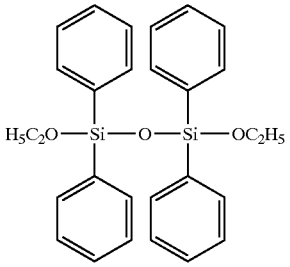

(11)

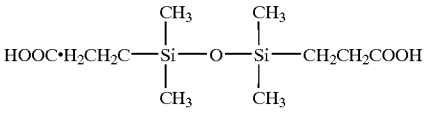

(12)

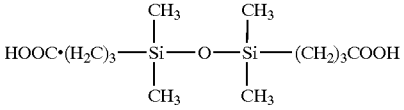

(13)

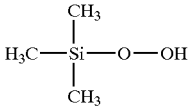

(14)

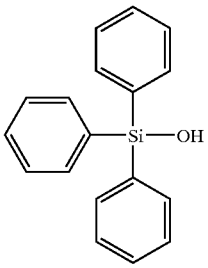

(15)

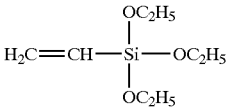

(16)

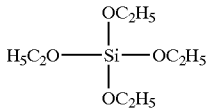

(17)

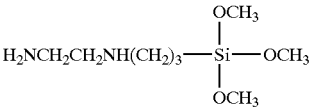

(18)

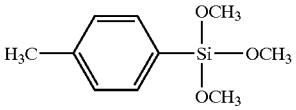

-continued (19)

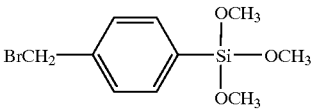

(20)

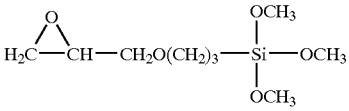

(21)

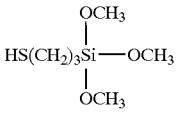

(22)

$Si(OCH_3)_4$

With respect to the previously mentioned silicone resin of formula (I), there can be preferably employed the commercially available products "KR-212™", "KR-213™", "KR-214™", "KR-215™", "KR-216™", and "KR-218™", made by Shin-Etsu Chemical Co., Ltd.

According to the present invention, the amino-group-containing modified silicone resin for use in the coating layer may be prepared by modifying a silicone resin using an amino-group-containing silicone compound.

Such a modified silicone resin can be prepared by the following methods:

[Method (2)]

There is proposed a method of carrying out the condensation reaction between a resin, such as acrylic resin, alkyd resin, melamine resin, epoxy resin, phenolic resin, esterified epoxy resin, urethane resin or ethyl cellulose resin, and an amino-group-containing silicone compound capable of undergoing the condensation reaction with the above-mentioned resin.

[Method (3)]

There is proposed a method of subjecting a modified silicone resin, for example, an alkyd-resin-modified silicone resin, an epoxy-resin-modified silicone resin, an urethane-resin-modified silicone resin, an acrylic-resin-modified silicone resin or a polyester-resin-modified silicone resin (described in Japanese Laid-Open Patent Application 55-157751) to amination using an amino-group-containing silicone compound.

As the alkyd-resin-modified silicone resin, there can be employed commercially available products "KR-206™", "KR-5206™", "KR-3073™" and "SA-4™", made by Shin-Etsu Chemical Co., Ltd. A commercially available product "BS-1002™" is usable as the epoxy-resin-modified silicone resin; a commercially available product "KR-302A™", as the acrylic-resin-modified silicone resin; a commercially available product "KR-3093™", as the acrylic-resin-modified silicone resin; and a commercially available product "KR-5203™", as the polyester-resin-modified silicone resin. All the above-mentioned products are made by Shin-Etsu Chemical Co., Ltd.

As the amino-group-containing silicone compound, the conventional amino silane coupling agent and amino-modified silicone oil can be employed. Specific examples of the amino silane coupling agent are γ-(2-aminoethyl) aminopropyl-trimethoxysilane, γ-(2-aminoethyl) aminopropylmethyl-dimethoxysilane and octadecyl dimethyl[3-(trimethoxy-silyl)propyl]ammonium chloride. The commercially available products "SH6020™", "SZ6023™", and "AY43-021™" made by Dow Corning Toray Silicone Co., Ltd. can be used as the respective amino silane coupling agents as mentioned above.

Further, an amino-modified silicone oil, for example, a commercially available product "SF8417™", made by Dow Corning Toray Silicone Co., Ltd., can also be used as the amino-group-containing silicone compound.

In this case, it is preferable that the amount ratio by weight of the resin-modified silicone resin to the amino-group-containing silicone compound to be added to the reaction system be in the range of (99.5:0.5) to (80:20), more preferably in the range of (99:1) to (90:10), and further preferably in the range of (98:2) to (95:5). When the resin-modified silicone resin is contained in such an amount as mentioned above, the obtained coating layer for use in the carrier particles can be provided with both the resistance to spent phenomenon and the resistance to wear. On the other hand, when the amount ratio of the amino-group-containing silicone compound is such as mentioned above, the triboelectric charging characteristics of the obtained carrier particles can become stable.

As the material for the core particles of the carrier according to the present invention, there can be employed conventional magnetic materials, for example, ferromagnetic metals such as iron and cobalt, and magnetite, hematite and ferrite.

In line with the trend toward a toner having small-size particles, the particle size of the carrier also tends to decrease in order to obtain efficient triboelectric charging performance. In the present invention, it is preferable that the particle diameter of the carrier particles be in the range of 20 to 100 $\mu$m, more preferably in the range of 30 to 50 $\mu$m when consideration is also given to the prevention of the carrier particles from being attracted to a latent electrostatic image together with the toner particles.

The carrier of the present invention is prepared, for example, in such a manner that the previously mentioned amino-group-containing resin-modified silicone resin is dissolved in a solvent to prepare a coating layer formation liquid, and the formation liquid thus prepared is coated on the surface of the core particles, and then the coated liquid is dried so as to evaporate the solvent and cured by the application of heat thereto.

The temperature at which the coating layer formation liquid is dried and cured, which varies depending upon the kind of resin for use in the coating layer, is preferably in the range of 70 to 250° C.

It is preferable that the thickness of the coating layer provided on each core particle be in the range of 0.02 to 2 $\mu$m, more preferably in the range of 0.05 to 1 $\mu$m, and further preferably in the range of 0.1 to 0.6 $\mu$m. When the thickness of the coating layer for use in the carrier particles is within the above-mentioned range, the fluidity of the carrier does not decrease, and at the same time, peeling of the coating layer can be minimized during the repeated operations.

According to the present invention, there is provided a two-component developer comprising a toner and the above-mentioned carrier. In the developer of the present invention, it is proper that the amount of toner be in the range of about 1 to 60 parts by weight with respect to 100 parts by weight of the carrier.

The toner for use in the present invention comprises a binder resin and a coloring agent.

The conventionally known resins can be used as the binder resins for use in the toner. In particular, as the binder resin, it is preferable to employ a styrene resin such as a styrene homopolymer or a copolymer comprising a styrene monomer and a vinyl monomer.

Specific examples of the above-mentioned vinyl monomer include ethylene unsaturated monoolefins such as ethylene, propylene and isobutylene; halogenated vinyl monomers such as vinyl chloride, vinyl bromide and vinyl fluoride; vinyl esters such as vinyl acetate; acrylic esters such as methyl acrylate, ethyl acrylate and phenyl acrylate; vinyl ethers such as vinyl methyl ether and vinyl ethyl ether; vinylketones such as vinyl methyl ketone and vinyl hexyl ketone; N-vinyl compounds such as N-vinylpyrrole and N-vinylpyrrolidone; acrylonitrile; methacrylonitrile; acrylamide; and methacrylamlde. These vinyl monomers can be employed alone or in combination.

In addition to the above-mentioned styrene resins, polyester resin, polyethylene resin, polypropylene resin, vinyl ester resin, rosin-modified phenol-formalin resin and epoxy resin, and a mixture of the above-mentioned resins can also be used as the binder resins.

As the coloring agent for use in the toner for use in the present invention, any conventional coloring agents can be employed.

Examples of the yellow coloring agent are C.I. Pigment Yellow 1 (SYMULER FAST YELLOW GH™, made by Dainippon Ink and Chemicals, Incorporated); C.I. Pigment Yellow 3 (SYMULER FAST YELLOW 10GH™, made by Dainippon Ink and Chemicals, Incorporated), C.I. Pigment Yellow 12 (SYMULER FAST YELLOW GF™, made by the Dainippon Ink and Chemicals, Incorporated, YELLOW 152™, made by Arimoto Chemical Co., Ltd, PIGMENT YELLOW GRT™, made by Sanyo Color Works, Ltd., SUMIKAPRINT.

YELLOW ST-O™, made by Sumitomo Chemical Co., Ltd., BENZIDINE YELLOW 1316™, made by Noma Chemical Industry Co., Ltd., SEIKA FAST YELLOW 2300™, made by Dainichiseika Color & Chemicals Mfg. Co., Ltd., and LIONEL YELLOW GRT™, made by Toyo Ink Mfg. Col, Ltd.); C.I. Pigment Yellow 13 (SYMULER FAST YELLOW GRF™, made by Dainippon Ink and Chemicals, Incorporated); C.I. Pigment Yellow 14 (SYMULER FAST YELLOW 5GR™, made by Dainippon Ink and Chemicals, Incorporated); and C.I. Pigment Yellow 17 (SYMULER FAST YELLOW 8GR™, made by Dainippon Ink and Chemicals, Incorporated, and LIONOL YELLOW FGNT™, made by Toyo Ink Mfg. Co., Ltd.).

Examples of the magenta coloring agent are C.I. Pigment Red 5 (SYMULER FAST CARMINE FB™, made by Dainippon Ink and Chemicals, Incorporated); C.I. Pigment Red 18 (SANYO TOLUIDINE MAROON MEDIUM™, made by Sanyo Color Works, Ltd.); C.I. Pigment Red 21 (SANYO FAST RED GR™, made by Sanyo Color Works, Ltd.); C.I. Pigment Red 22 (SYMULER FAST BRILL SCARLET BG™, made by Dainippon Ink and Chemicals, Incorporated); C.I. Pigment Red 57 (SYMULER BRILL CARMINE LB™, made by Dainippon Ink and Chemicals, Incorporated); C.I. Pigment Red 81 (SYMULEX RHODAMINE Y TONER F™, made by Dainippon Ink and Chemicals, Incorporated; C.I. Pigment Red 112 (SYMULER FAST RED FGR™, made by Dainippon Ink and Chemicals, Incorporated).

C.I. Pigment Red 114 (SYMULER FAST CARMINE BS™, made by Dainippon Ink and Chemicals, Incorporated); and C.I. Pigment Red 122 (FASTOGEN SUPER MAGENTA RE 02™, made by Dainippon Ink and Chemicals, Incorporated).

Examples of the cyan coloring agent are C.I. Pigment Blue 15 (FASTOGEN BLUE GS™, made by Dainippon Ink and Chemicals, Incorporated, and CHROMOFINE SR™, made by Dainichiseika Color & Chemicals Mfg. Co., Ltd); C.I. Pigment Blue 16 (SUMITONE CYANINE BLUE LG™, made by Sumitomo Chemical Col, Ltd.); C.I. Pigment Blue 15:3 (CYANINE BLUE GGK™, made by Nippon Pigment Co., Ltd., and LIONEL BLUE FG7351™, made by Toyo Ink Mfg. Co., Ltd); C.I. Pigment Green 7 PHTHALOCYANINE GREEN™, made by Tokyo Printing Ink Mfg. Co. Ltd.); and C.I. Pigment Green 36 (CYANINE GREEN ZYL™, made by Toyo Ink Mfg. Col, Ltd.).

Examples of the black coloring agent are carbon black, spirit black and Aniline Black (C.I. Pigment Black 1).

The toner for use in the present invention may further comprise a charge control agent. Various kinds of conventional charge control agents are usable, and specific examples of such a charge control agents are as follows: a metal-containing monoazo dye, nitrohumic acid and salts thereof, salicylic acid, naphthoic acid, dicarboxylic acid complexes of metals such as Co, Cr and Fe, amino compounds, quaternary ammonium compounds, and organic dyes.

Furthermore, various additives may be externally added to the toner particles. Examples of those additives for use in the present invention include a fluidity-imparting agent such as colloidal silica; an abrasive, for example, metallic oxides such as titanium oxide and aluminum oxide, and silicon carbide; and a lubricant such as a fatty acid metallic salt.

In the toner for use in the present invention, it is preferable that the amount ratio of binder resin be in the range of 75 to 93 wt. %; that of the coloring agent, in the range of 3 to 10 wt. %; and that of the charge control agent and other additives, be in the range of 1 to 7 wt. %, of the total weight of the toner.

Other features of this invention will become apparent in the course of the following description of exemplary embodiments, which are given for illustration of the invention and are not intended to be limiting thereof.

SYNTHESIS EXAMPLE 1

A silicone resin represented by the previously mentioned formula (6), methylmethacrylate, styrene, and 2-hydroxyethyl methacrylate were placed in a flask equipped with a stirrer, condenser, a nitrogen-gas introducing tube and a thermometer to carry out the condensation reaction. Thus, there was obtained an acryl-modified silicone resin (A) having the following characteristics:

Silicon content (in a solid matter): 30 wt. %

Organic resin content (in a solid matter): 70 wt. %

Solid matter (in a coating liquid): 50 wt. %

SYNTHESIS EXAMPLE 2

A silicone resin represented by the previously mentioned formula (6), methyl methacrylate, styrene, 2-hydroxyethyl methacrylate, and a commercially available amino silane coupling agent (Trademark "SH6020", made by Dow Corning Toray Silicone Co., Ltd.) were placed in a flask equipped with a stirrer, condenser, a nitrogen-gas introducing tube and a thermometer to carry out the condensation reaction. Thus, there was obtained an acryl-modified silicone resin (B), that is, a silicone resin modified using an amino-group-containing silicone compound, having the following characteristics:

Silicon content (in a solid matter): 30 wt. %

Organic resin content (in a solid matter): 70 wt. %

Amino silane coupling agent: 10 wt. %

Solid matter (in a coating liquid): 50 wt. %.

SYNTHESIS EXAMPLE 3

A silicone resin represented by the previously mentioned formula (6), methyl methacrylate, styrene, 2-hydroxyethyl methacrylate, and an allylamine derivative were placed in a flask equipped with a stirrer, condenser, a nitrogen-gas introducing tube and a thermometer to carry out the condensation reaction. Thus, there was obtained an acryl-modified silicone resin (C), that is, a silicone resin modified using an amino-group-containing organic compound, having the following characteristics:

Silicon content (in a solid matter): 30 wt. %

Organic resin content (in a solid matter): 70 wt. %

Solid matter (in a coating liquid): 50 wt. %.

EXAMPLE 1-1

Preparation of Carrier (a)

240 parts by weight of the acryl-modified silicone resin (A) prepared in Synthesis Example 1, and 12 parts by weight of the commercially available amino silane coupling agent (Trademark "SH6020", made by Dow Corning Toray Silicone Co., Ltd.) were dissolved and dispersed in 360 parts by weight of butyl cellosolve, so that a coating layer formation liquid for carrier particles was prepared.

The thus prepared coating layer formation liquid and 5,000 parts by weight of core particles (commercially available ferrite particles "F-300™", made by Powder Tech Co., Ltd.) were placed in a fluidized bed coating apparatus. The surface of the core particles was coated with the coating layer formation liquid by the fluidized bed coating method, and the resin layer coated carrier particles were dried and cured at 130° C. for 2 hours.

Thus, the coating layer with a thickness of about 0.6 $\mu$m was provided on each core particle, thereby obtaining a carrier (a) according to the present invention.

EXAMPLE 1-2

Preparation of Carrier (b)

240 parts by weight of the amino-group-containing acryl-modified silicone resin (B) prepared in Synthesis Example 2 were dissolved and dispersed in 360 parts by weight of butyl cellosolve, so that a coating layer formation liquid for carrier particles was prepared.

The thus prepared coating layer formation liquid and 5,000 parts by weight of core particles (commercially available ferrite particles "F-300™", made by Powder Tech Co., Ltd.) were placed in a fluidized bed coating apparatus. The surface of the core particles was coated with the coating layer formation liquid by the fluidized bed coating method, and the resin layer coated carrier particles were dried and cured at 130° C. for 2 hours.

Thus, the coating layer with a thickness of about 0.6 $\mu$m was provided on the core particles, thereby obtaining a carrier (b) according to the present invention.

EXAMPLE 1-3

Preparation of Carrier (c)

The procedure for preparation of the carrier (a) in Example 1-1 was repeated except that the commercially available amino silane coupling agent "SH6020™", made by Dow Corning Toray Silicone Co., Ltd. for use in the coating layer formation liquid in Example 1-1 was replaced by the commercially available amino-modified silicone oil "SF8417™", made by Dow Corning Toray Silicone Co., Ltd.

Thus, a carrier (c) according to the present invention was obtained.

EXAMPLE 1-4

Preparation of Carrier (d)

The procedure for preparation of the carrier (b) in Example 1-2 was repeated except that the amino-group-containing acryl-modified silicone resin (B) for use in the coating layer formation liquid in Example 1-2 was replaced by the amino-group-containing acryl-modified silicone resin (C) prepared in Synthesis Example 3.

Thus, a carrier (d) according to the present invention was obtained.

COMPARATIVE EXAMPLE 1-1

Preparation of Carrier (e)

The procedure for preparation of the carrier (a) in Example 1-1 was repeated except that the commercially available amino silane coupling agent "SH6020™", made by Dow Corning Toray Silicone Co., Ltd. was eliminated from the formulation for the coating layer formation liquid employed in Example 1-1.

Thus, a comparative carrier (e) was obtained.

Preparation of Toner

A mixture of the following components was completely stirred in a Henschel mixer:

| | Parts by weight |
|---|---|
| Polyester resin | 80 |
| Styrene-acrylate copolymer | 20 |
| Phthalocyanine blue CHROMOFINE BLUE KBN (C.I. Pigment Blue 15) made by Dainichiseika Color and Chemicals Mfg. Co., Ltd. | 5 |

-continued

| | Parts by weight |
|---|---|
| Cr-containing azo dye represented by the following formula: | 2 |

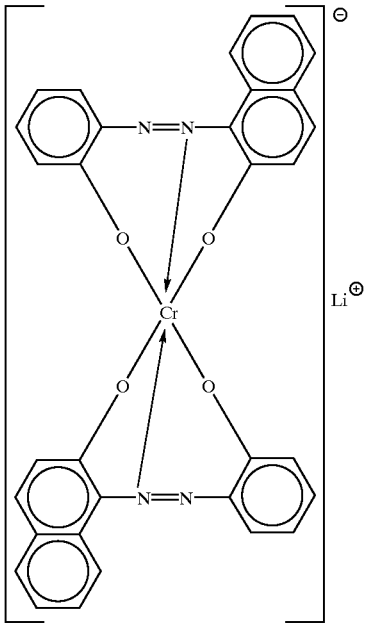

The thus obtained mixture was fused and kneaded in a roll mill at temperature of 130 to 140° C. for about 30 minutes. The kneaded mixture was cooled to room temperature, and pulverized and classified, so that coloring particles with a particle diameter of 5 to 13 μm were obtained.

1.0 part by weight of the commercially available hydrophobic silica (Trademark "R972", made by Nippon Aerosil Co., Ltd.) was added to 100 parts by weight of the above prepared coloring particles, and the resultant mixture was mixed in a Henschel mixer. Thus, a toner was prepared.

EXAMPLE 2-1

Preparation of Two-component Developer No. 1

Five parts by weight of the above-mentioned toner and 95 parts by weight of the carrier (a) prepared in Example 1-1 were mixed in a ball mill, so that a two-component developer No. 1 according to the present invention was obtained.

EXAMPLE 2-2

Preparation of Two-component Developer No. 2

The procedure for preparation of the two-component developer No. 1 in Example 2-1 was repeated except that the carrier (a) used in Example 2-1 was replaced by the carrier (b) prepared in Example 1-2.

Thus, a two-component developer No. 2 according to the present invention was obtained.

EXAMPLE 2-3

Preparation of Two-component Developer No. 3

The procedure for preparation of the two-component developer No. 1 in Example 2-1 was repeated except that the carrier (a) used in Example 2-1 was replaced by the carrier (c) prepared in Example 1-3.

Thus, a two-component developer No. 3 according to the present invention was obtained.

EXAMPLE 2-4

Preparation of Two-component Developer No. 4

The procedure for preparation of the two-component developer No. 1 in Example 2-1 was repeated except that the carrier (a) used in Example 2-1 was replaced by the carrier (d) prepared in Example 1-4.

Thus, a two-component developer No. 4 according to the present invention was obtained.

COMPARATIVE EXAMPLE 2-1

Preparation of Comparative Two-component Developer No. 1

The procedure for preparation of the two-component developer No. 1 in Example 2-1 was repeated except that the carrier (a) used in Example 2-1 was replaced by the carrier (e) prepared in Comparative Example 1-1.

Thus, a comparative two-component developer No. 1 was obtained.

200 g of each of the two-component developers obtained in Examples 2-1 to 2-4 and Comparative Example 2-1 was incorporated in a commercially available copying machine (PRETER 750, made by Ricoh Company, Ltd.), and 100,000 copies were made.

Then, the following evaluations were carried out.

(1) Charging Characteristics

At the time of making a first copy and after making 100,000 copies, 3 g of the developer was taken out from the copying machine to measure the charge quantity of toner by the blow-off method.

From the initial charge quantity ($Q_1$) of toner and the charge quantity ($Q_2$) obtained after making 100,000 copies, the change ratio of charge quantity of toner was calculated in accordance with the following formula:

$$\text{Change ratio of charge quantity of toner (\%)} = [(Q_1 - Q_2)/(Q_1)] \times 100$$

The results are shown in TABLE 1.

(2) Image Density

At the time of making a first copy and after making 100,000 copies, the image densities of the obtained copy image were measured using a McBeth densitometer.

The results are shown in TABLE 2.

(3) Toner Deposition of Background

After making 100,000 copies, the toner deposition of the background was visually inspected, and evaluated in accordance with the following scale:

5: clear (zero amount of toner deposition)

4: very slight

3: noticeable

2: very noticeable

1: significant

The results are shown in TABLE 2.

TABLE 1

| | Charge Quantity (μC/g) | | |
|---|---|---|---|
| | At initial stage | After making of 100,000 copies | Change Ratio of Charge Quantity (%) |
| Ex. 1 | −20.9 | −17.1 | 18 |
| Ex. 2 | −25.7 | −22.9 | 11 |
| Ex. 3 | −22.3 | −19.4 | 13 |
| Ex. 4 | −30.2 | −28.1 | 7 |
| Comp. Ex. 1 | −15.1 | −9.8 | 35 |

TABLE 2

| | Image Density | | Toner Deposition |
|---|---|---|---|
| | At initial stage | After making of 100,000 copies | of Background after making of 100,000 copies |
| Ex. 1 | 1.51 | 1.53 | 4 |
| Ex. 2 | 1.44 | 1.45 | 5 |
| Ex. 3 | 1.48 | 1.52 | 4 |
| Ex. 4 | 1.42 | 1.43 | 5 |
| Comp. Ex. 1 | 1.54 | 0.99 | 2 |

As previously explained, the carrier of the present invention shows stable triboelectric charging characteristics and a long life, so that the obtained two-component developer of the present invention can achieve efficient development.

Japanese Patent Application No. 10-103608 filed Mar. 31, 1998 is hereby incorporated by reference.

What is claimed is:

1. A carrier for a two-component developer for developing a latent electrostatic image, comprising:

carrier particles, said carrier particles comprising a core particle, and a single coating layer provided on the surface of said core particle, wherein said single coating layer consists essentially of an amino-modified silicone oil and a resin modified silicone resin, and wherein an amount ratio by weight of said amino-modified silicone oil to said resin modified silicone resin is from (1:99) to (10:90).

2. The carrier of claim 1, wherein said resin modified silicone resin is an alkyd-resin-modified silicone resin.

3. The carrier as claimed in claim 1, wherein said resin modified silicone resin is an epoxy-resin-modified silicone resin.

4. The carrier as claimed in claim 1, wherein said resin modified silicone resin is an urethane-resin-modified silicone resin.

5. The carrier as claimed in claim 1, wherein said resin modified silicone resin is an acrylic-resin-modified silicone resin.

6. The carrier as claimed in claim 1, wherein said resin modified silicone resin is a polyester-resin-modified silicone resin.

7. A two-component developer for developing a latent electrostatic image, comprising:

(i) a toner and (ii) a carrier comprising carrier particles, said carrier particles comprising a core particle and a single coating layer provided on the surface of said core particle, wherein said single coating layer consists essentially of an amino-modified silicone oil and a resin modified silicone resin, and wherein an amount ratio by weight of said amino-modified silicone oil to said resin modified silicone resin is from (1:99) to (10:90).

8. The developer of claim 7, wherein said resin modified silicone resin is an alkyd-resin-modified silicone resin.

9. The developer as claimed in claim 7, wherein said resin modified silicone resin is an epoxy-resin-modified silicone resin.

10. The developer as claimed in claim 7, wherein said resin modified silicone resin is a an urethane-resin-modified silicone resin.

11. The developer as claimed in claim 7, wherein said resin modified silicone resin is an acrylic-resin-modified silicone resin.

12. The developer as claimed in claim 7, wherein said resin modified silicone resin is polyester-resin-modified silicone resin.

* * * * *